US012024379B2

(12) United States Patent
Mori

(10) Patent No.: US 12,024,379 B2
(45) Date of Patent: Jul. 2, 2024

(54) SHEET FEEDING DEVICE AND IMAGE FORMING APPARATUS

(71) Applicant: CANON KABUSHIKI KAISHA, Tokyo (JP)

(72) Inventor: Hideki Mori, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 179 days.

(21) Appl. No.: 17/871,133

(22) Filed: Jul. 22, 2022

(65) Prior Publication Data

US 2023/0048110 A1 Feb. 16, 2023

(30) Foreign Application Priority Data

Aug. 11, 2021 (JP) ..... 2021-131440

(51) Int. Cl.
*B65H 9/18* (2006.01)
*B65H 1/04* (2006.01)
*B65H 9/04* (2006.01)

(52) U.S. Cl.
CPC ..... *B65H 1/04* (2013.01); *B65H 9/04* (2013.01); *B65H 2551/29* (2013.01); *B65H 2601/272* (2013.01)

(58) Field of Classification Search
CPC ... B65H 1/04; B65H 3/66; B65H 5/38; B65H 9/08; B65H 9/004; B65H 9/18; B65H 31/34; B65H 2301/3621; B65H 2301/36212; B65H 2301/3613; B65H 2404/742; B65H 2551/29; B65H 2601/272
USPC ..... 271/240, 248, 255; 270/58.12, 58.16, 270/58.17, 58.27
See application file for complete search history.

(56) References Cited

U.S. PATENT DOCUMENTS 9,637,332 B2 * 5/2017 Tanaka ..... B65H 1/04
10,226,948 B2 * 3/2019 Fujita ..... B41J 13/106
2006/0008292 A1 * 1/2006 Watanabe ..... G03G 15/6552 399/107

FOREIGN PATENT DOCUMENTS

JP H069064 A 1/1994

* cited by examiner

*Primary Examiner* — Leslie A Nicholson, III
(74) *Attorney, Agent, or Firm* — ROSSI, KIMMS & McDOWELL LLP

(57) ABSTRACT

A sheet feeding device includes a sheet supporting unit, a sheet feeding unit, and a regulating member. The regulating member includes a supporting surface portion on which the sheet is placed, and a regulation surface portion provided continuously with the supporting surface portion and configured to regulate the position of the sheet in a width direction. The supporting surface portion includes a supporting surface color indicating portion including an end portion of the supporting surface portion on a side of the regulation surface portion and having a color with brightness of 7 or less in the Munsell color system. The regulation surface portion includes a regulation surface color indicating portion including an end portion of the regulation surface portion on a side of the supporting surface portion and having a color with brightness higher than the brightness of the supporting surface color indicating portion.

14 Claims, 13 Drawing Sheets

SHEET FEEDING DEVICE AND IMAGE FORMING APPARATUS

BACKGROUND OF THE INVENTION

Field of the Invention

The present disclosure relates to a sheet feeding device that feeds a sheet and an image forming apparatus equipped with the sheet feeding device.

Description of the Related Art

Conventionally, in an image forming apparatus such as a printer, an image forming apparatus equipped with a sheet placement unit on which a sheet to be fed to an image forming unit is placed is widely used. Such a sheet placement unit is known to be provided with a pair of sheet regulating members movable in a width direction of the sheet.

In the image forming apparatus described in Japanese Patent Laid-Open No. H06-9064, in the manual feed tray, each sheet regulating member is meshed with one pulley gear by a rack and moves by the same distance. A slide volume that interlocks with the pulley gear is provided as the detection device, and the length of the sheet in the width direction is determined by detecting the movement amount of the slide volume.

When the user moves the sheet regulating member, the sheet regulating member may be set at a position where the interval between the sheet regulating members is larger than the width of the sheet. In such a case, there is a possibility that the sheet is installed obliquely with respect to a feeding direction. In addition, even when the sheet regulating member is set at a correct position, the sheet can be installed obliquely when the width of the sheet is smaller than the original width due to dimensional errors in manufacturing. However, in the conventional configuration, it is difficult for the user to recognize that the sheet is installed obliquely, and the sheet may be fed in a state where the sheet is installed obliquely. When the inclination angle of the placed sheet increases, there is a possibility that the skew feeding correction device fails to correct the inclination angle and the image formed on the sheet is misaligned, and there is a possibility that a wrinkle or the like occurs on the sheet due to stress applied on the sheet by the skew feeding correction unit.

SUMMARY OF THE INVENTION

An object of the present disclosure is to provide a sheet feeding device and an image forming apparatus capable of suppressing occurrence of misalignment of an image formed on a sheet, wrinkles of the sheet, and the like.

According to a first aspect of the present invention, a sheet feeding device includes a sheet supporting unit configured to support a sheet, a sheet feeding unit configured to feed the sheet supported on the sheet supporting unit in a feeding direction, and a regulating member provided to be movable in a width direction intersecting the feeding direction and configured to regulate a position of the sheet supported on the sheet supporting unit in the width direction. In the regulating member includes a supporting surface portion on which the sheet is placed, and a regulation surface portion provided continuously with the supporting surface portion and configured to abut on an end portion of the sheet in the width direction to regulate the position of the sheet in the width direction. The supporting surface portion includes a supporting surface color indicating portion including an end portion of the supporting surface portion on a side of the regulation surface portion and having a color with brightness of 7 or less in the Munsell color system. The regulation surface portion includes a regulation surface color indicating portion including an end portion of the regulation surface portion on a side of the supporting surface portion and having a color with brightness higher than the brightness of the supporting surface color indicating portion.

According to a second aspect of the present invention, a sheet feeding device includes a sheet supporting unit configured to support a sheet, a sheet feeding unit configured to feed the sheet supported on the sheet supporting unit in a feeding direction, and a regulating member that is provided to be movable in a width direction intersecting the feeding direction and configured to regulate a position of the sheet supported on the sheet supporting unit in the width direction. The regulating member includes a supporting surface portion on which the sheet is placed, and a regulation surface portion provided continuously with the supporting surface portion and configured to abut on an end portion of the sheet in the width direction to regulate the position of the sheet in the width direction. The supporting surface portion includes a supporting surface pattern portion including an end portion of the supporting surface portion on a side of the regulation surface portion and having a pattern formed on the entire supporting surface pattern portion. The regulation surface portion includes a regulation surface plain portion including an end portion of the regulation surface portion on a side of the supporting surface portion and being entirely plain.

According to a third aspect of the present invention, a sheet feeding device includes a sheet supporting unit configured to support a sheet, a sheet feeding unit configured to feed the sheet supported on the sheet supporting unit in a feeding direction, and a regulating member that is provided to be movable in a width direction intersecting the feeding direction and configured to regulate a position of the sheet supported on the sheet supporting unit in the width direction. The regulating member includes a supporting surface portion on which the sheet is placed, and a regulation surface portion provided continuously with the supporting surface portion and configured to abut on an end portion of the sheet in the width direction to regulate the position of the sheet in the width direction. The supporting surface portion includes a supporting surface pattern portion including an end portion of the supporting surface portion on a side of the regulation surface portion and having a pattern formed on the entire supporting surface pattern portion. The regulation surface portion includes a regulation surface pattern portion including an end portion of the regulation surface portion on a side of the supporting surface portion and having a pattern different from the pattern of the supporting surface pattern portion formed on the entire regulation surface pattern portion.

According to a fourth aspect of the present invention, a sheet feeding device includes a sheet supporting unit configured to support a sheet, a sheet feeding unit configured to feed the sheet supported on the sheet supporting unit in a feeding direction, and a regulating member that is provided to be movable in a width direction intersecting the feeding direction and configured to regulate a position of the sheet supported on the sheet supporting unit in the width direction. The regulating member includes a supporting surface portion on which the sheet is placed, and a regulation surface portion provided continuously with the supporting surface portion and configured to abut on an end portion of the sheet in the width direction to regulate a position of the sheet in the width direction. The supporting surface portion includes a supporting surface color indicating portion including an end portion of the supporting surface portion on a side of the regulation surface portion and having a color with brightness of 7 or less in the Munsell color system. The regulation surface portion includes a regulation surface pattern portion including an end portion of the regulation surface portion on a side of the supporting surface portion and having a pattern formed on the entire regulation surface pattern portion.

According to a fifth aspect of the present invention, an image forming apparatus includes the sheet feeding device, and an image forming unit configured to form an image on a sheet fed by the sheet feeding device.

Further features of the present invention will become apparent from the following description of exemplary embodiments with reference to the attached drawings.

DESCRIPTION OF THE EMBODIMENTS

First Embodiment

Hereinafter, a first embodiment of the present disclosure will be described in detail with reference to FIGS. 1 to 5. In the present embodiment, a tandem type full-color printer is described as an example of the image forming apparatus 1. The present disclosure can also be implemented in another embodiment in which a part or all of the configuration of each embodiment is replaced with an alternative configuration thereof as long as the side regulating portion that regulates a width direction of the sheet on the feeding tray is provided. Therefore, it can be implemented not only the electrophotographic image forming apparatus but also various image forming apparatuses using an offset printing method, an inkjet method, and the like. The electrophotographic system is not limited to the tandem system in which a plurality of image forming units are arranged side by side, and can be implemented by a rotary system in which a plurality of image forming units are arranged in a cylindrical shape. Further, the present disclosure is not limited to the intermediate transfer method in which the toner image is primarily transferred to the intermediate transfer body and then secondarily transferred to the sheet, and the present disclosure can also be implemented by a direct transfer method in which the toner image is directly transferred from the photosensitive member to the sheet. Furthermore, the color is not limited to full color, and may be monochrome or two-color.

Image Forming Apparatus

Figure 1:
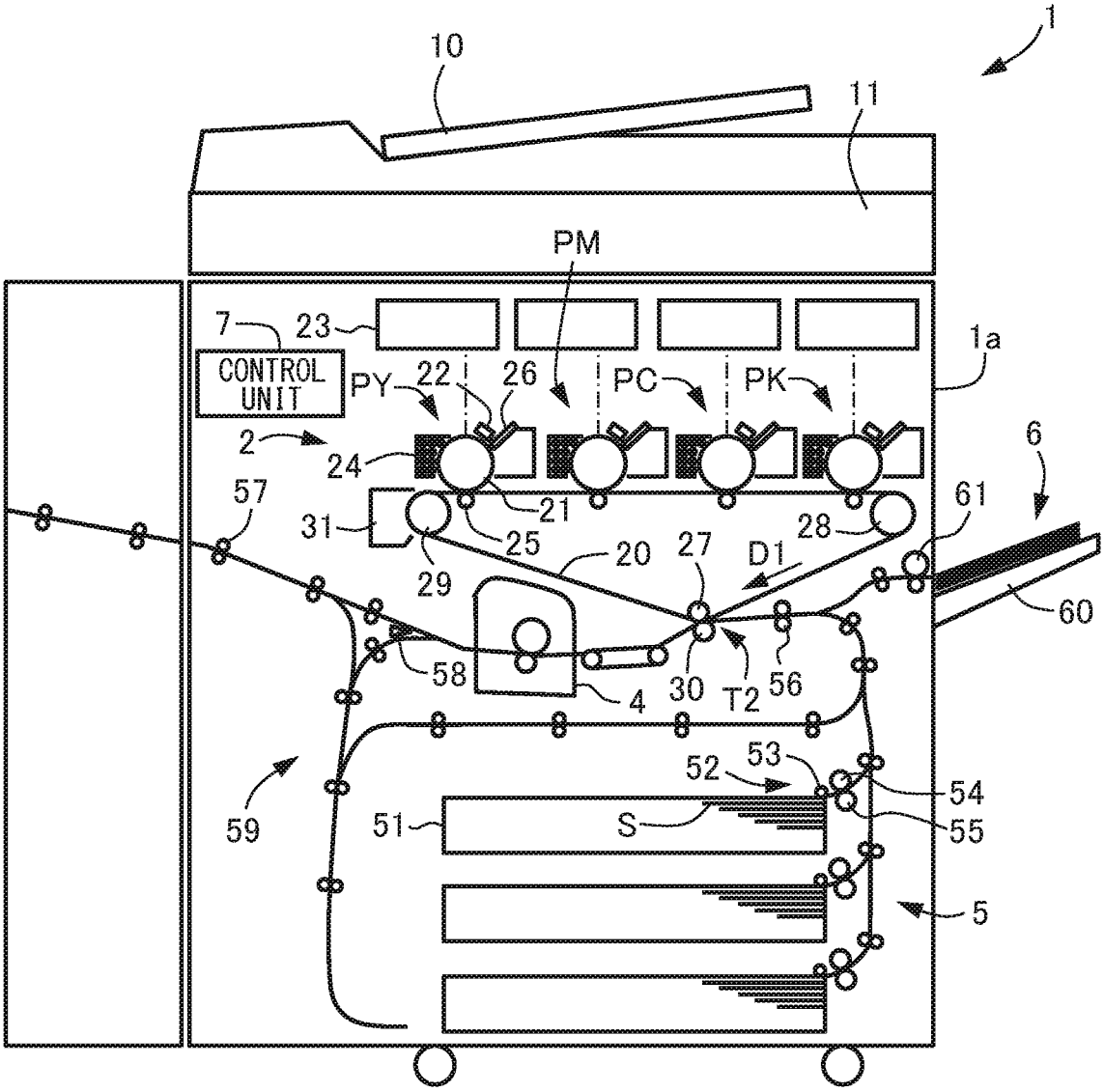
FIG. 1 is a cross-sectional view illustrating a schematic configuration of an image forming apparatus according to a first embodiment.

FIG. 1 is a schematic configuration diagram of an image forming apparatus 1 according to the present embodiment. The image forming apparatus 1 is mainly configured by housing an image forming unit 2, a fixing unit 4, a sheet feeding unit 5, an openable and closable manual feeding unit 6, and a control unit 7 in an apparatus body 1*a*. In addition, the image forming apparatus 1 includes, on the upper side of the apparatus body 1*a*, an automatic feeding unit 10 that automatically feeds a document and a document reading unit 11 that reads an image from the document, and forms an image on the sheet S and outputs the sheet on the basis of image information read from the document or image information input from an external device. Note that the sheet S includes, in addition to plain paper, special paper such as coated paper, a recording material having a special shape such as an envelope or index paper, a plastic film for an overhead projector, a cloth, and the like.

The image forming unit 2 accommodated in the apparatus body 1*a* has a configuration of an intermediate transfer tandem system including four image forming units PY, PM, PC, and PK and an intermediate transfer belt 20. The image forming units PY to PK form toner images of yellow (Y), magenta (M), cyan (C), and black (K). Since the configuration of each image forming unit is basically similar except that the color of the stored toner is different, the configuration of the image forming unit and the toner image forming operation will be described using the image forming unit PY containing yellow toner as an example.

When the image forming unit PY is requested to form a toner image, a photosensitive drum 21 is rotationally driven, and a charging device 22 uniformly charges the surface of the photosensitive drum 21. An exposing unit 23 provided on the upper part of the apparatus body 1*a* irradiates the photosensitive drum 21 with laser light based on image information to expose the surface of the drum, thereby forming an electrostatic latent image on the photosensitive drum 21. Then, the electrostatic latent image is visualized (developed) by the toner supplied from a developing unit 24, whereby a toner image is formed on the surface of the photosensitive drum 21. Similarly, in the image forming units PM, PC, and PK, toner images of respective colors are formed on the photosensitive drum 21. The toner images formed by the image forming units PY to PK are primarily transferred from the photosensitive drums 21 to the intermediate transfer belt 20 as an intermediate transfer body so as to overlap each other by the primary transfer roller 25. An adhering substance such as toner remaining on the photosensitive drum 21 is removed by a cleaning device 26.

The intermediate transfer belt 20 is wound around a secondary transfer inner roller 27, a tension roller 28, a driving roller 29, and the like, and is rotationally driven in a direction corotating with the photosensitive drum 21. The toner image carried on the intermediate transfer belt 20 is secondarily transferred to the sheet S in a secondary transfer unit T2 formed by a secondary transfer outer roller 30 facing the secondary transfer inner roller 27 and the intermediate transfer belt 20. An adhering substance such as toner remaining on the intermediate transfer belt 20 is removed by a belt cleaning device 31. The sheet S to which the toner image has been transferred is delivered to the fixing unit 4. The fixing unit 4 includes a belt conveyance device that nips and conveys the sheet S and a heat source that heats the sheet S, and applies heat and pressure to the toner image while conveying the sheet S. As a result, the toner is melted and fixed to the sheet S.

In parallel with the image forming process by the image forming unit 2, the sheet feeding unit 5 executes a feeding operation of feeding the sheet S toward the image forming unit 2. The sheet feeding unit 5 includes a feeding cassette 51 as a sheet storage unit capable of storing the sheet S, and a feeding unit 52 as a sheet feeding unit that feeds the sheet S from the feeding cassette 51. Note that, in the present embodiment, the three feeding cassettes 51 are provided, but since the configurations are similar, only the uppermost feeding cassette 51 will be described as a representative. The feeding unit 52 includes a pickup roller 53 that feeds the sheet S from the feeding cassette 51, a feed roller 54 that receives the sheet S from the pickup roller 53 and conveys the sheet S, and a retard roller 55 that is pressed against the feed roller 54. The sheet S conveyed by the feed roller 54 can be separated from other sheets by the retard roller 55. Note that the feeding unit 52 is an example of a sheet feeding unit, and may be replaced with another feeding mechanism using a separation pad method, an air feeding method, or the like.

A manual feeding unit 6, which is an example of a sheet feeding device in which a user can manually set the sheet S, is provided on a side portion of the apparatus body 1*a*. The manual feeding unit 6 includes a manual feed tray 60 that can be opened and closed with respect to the apparatus body 1*a*, and a feed roller 61 that feeds the sheet S placed on the manual feed tray 60 in the feeding direction. Details of the manual feeding unit 6 will be described below.

The sheet S fed from the sheet feeding unit 5 and the manual feeding unit 6 is conveyed to a registration unit 56. The registration unit 56 is an inclination correction unit, performs skew feeding correction of the sheet S, and feeds the sheet S toward the secondary transfer unit T2 in accordance with the progress of the toner image forming operation in the image forming unit 2. Then, the sheet S on which an image is formed by passing through the secondary transfer unit T2 and the fixing unit 4 is discharged to the outside of the apparatus body 1*a* by a sheet discharge roller pair 57, and is delivered to a sheet processing device such as a sheet discharge tray or a binding processing device supported by the apparatus body 1*a*. When duplex printing is performed, the sheet S is guided to the reversing unit 59 by the switching member 58, and is conveyed again toward the image forming unit 2 in a state where the front surface and the back surface of the sheet are switched by a switchback operation. After an image is formed on the back surface of the sheet S, the sheet S is discharged by the sheet discharge roller pair 57.

The control unit 7 includes a central processing unit (CPU) and memories such as a read only memory (ROM) and a random access memory (RAM). The CPU acquires various data input by an operation unit and stores the data in the memory, and can read print program from the memory and execute the print program in response to, for example, a user's startup operation such as turning on the power supply of the image forming apparatus 1. The memory stores, for example, various programs such as a printing program and various data such as an image forming job.

Manual Feeding Unit

Figure 2:
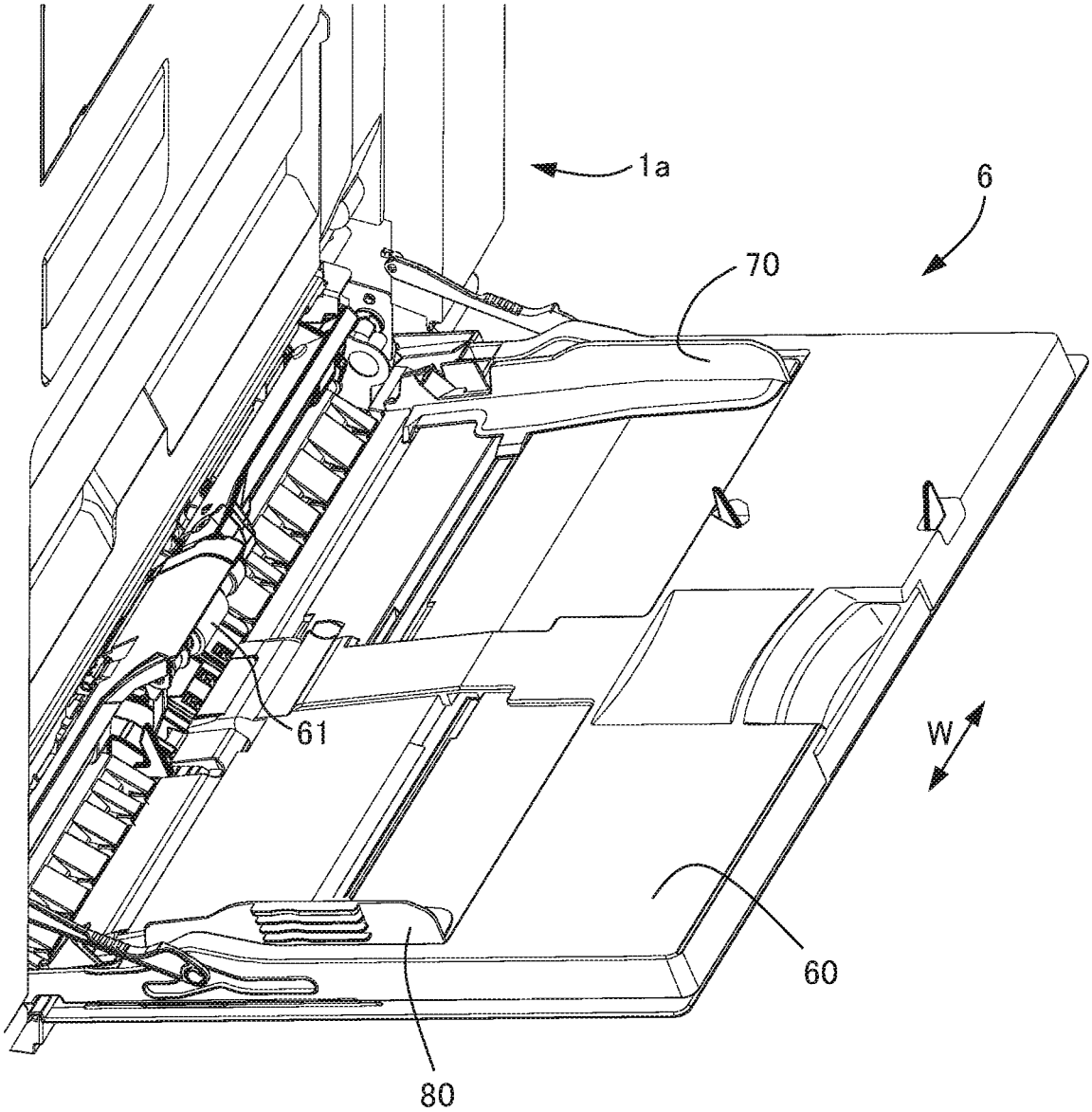
FIG. 2 is a perspective view illustrating a schematic configuration of a manual feeding unit according to the first embodiment.

Next, the manual feeding unit 6 that feeds the placed sheet S will be described with reference to FIGS. 2 to 5. As illustrated in FIG. 2, the manual feeding unit 6 includes a manual feed tray 60 which is an example of a sheet supporting unit on which the sheet S is supported, a feed roller 61 which is an example of a sheet feeding unit, and a pair of first side regulating portion 70 and second side regulating portion 80. The first side regulating portion 70 and the second side regulating portion 80 are regulating members in the present embodiment. The manual feed tray 60 is provided on a side wall of the apparatus body 1*a* so as to be openable and closable by swinging. Hereinafter, a case where the manual feed tray 60 is in the open state will be described.

The feed roller 61 feeds the sheet S placed on the manual feed tray 60. The pair of first side regulating portion 70 and second side regulating portion 80 is an example of a pair of first regulating member and second regulating member, and is disposed on both sides of the sheet S in the width direction W intersecting the feeding direction of the sheet S placed on the manual feed tray 60 to regulate the position of the sheet S in the width direction W. The first side regulating portion 70 is an example of a regulating portion, is provided to be movable in the width direction W, and regulates the position of the sheet S in the width direction W placed on the manual feed tray 60. The second side regulating portion 80 is provided to be movable in the width direction W in conjunction with the first side regulating portion 70, and abuts on the other end portion in the width direction W of the sheet S placed on the manual feed tray 60. In the present embodiment, the width direction W is a direction orthogonal to the feeding direction of the sheet S.

Figure 3:
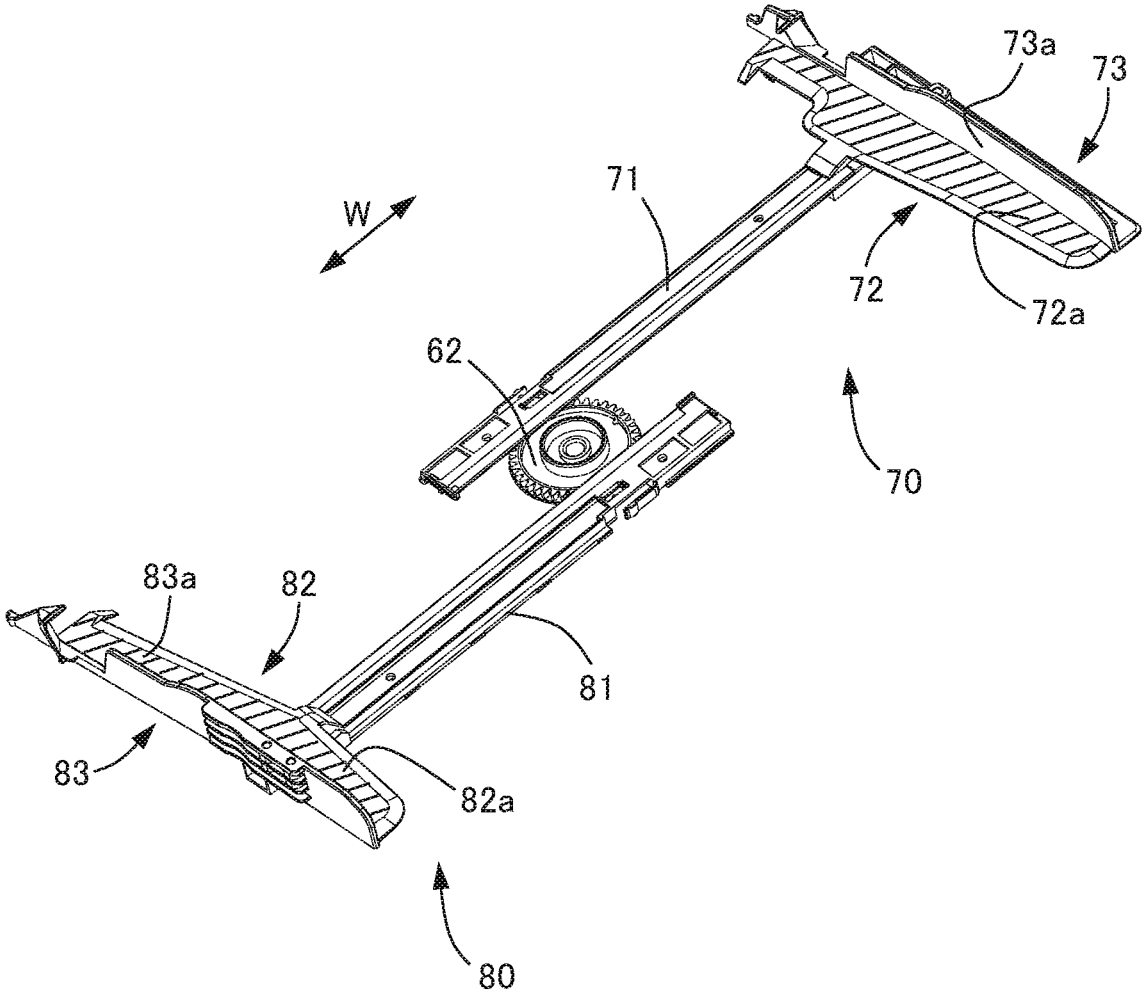
FIG. 3 is a perspective view illustrating a schematic configuration of a pair of side regulating portions according to the first embodiment.

As illustrated in FIG. 3, the first side regulating portion 70 includes a rack 71, a seating surface portion 72 as an example of a supporting surface portion on which the sheet S is placed, and a regulation surface portion 73. Similarly, the second side regulating portion 80 includes a rack 81, a seating surface portion 82 on which the sheet S is placed, and a regulation surface portion 83. The racks 71 and 81 mesh with and interlock with a pinion gear 62. As a result, at least one of the first side regulating portion 70 and the second side regulating portion 80 is movable in the width direction W, and in the present embodiment, both the first side regulating portion 70 and the second side regulating portion 80 are movable in synchronization with the width direction W of the sheet S. Note that one of the first side regulating portion 70 and the second side regulating portion 80 may be fixed so as not to be movable. In addition, only the first side regulating portion 70 may be provided to be movable, and the second side regulating portion 80 may not be provided.

Figure 4:
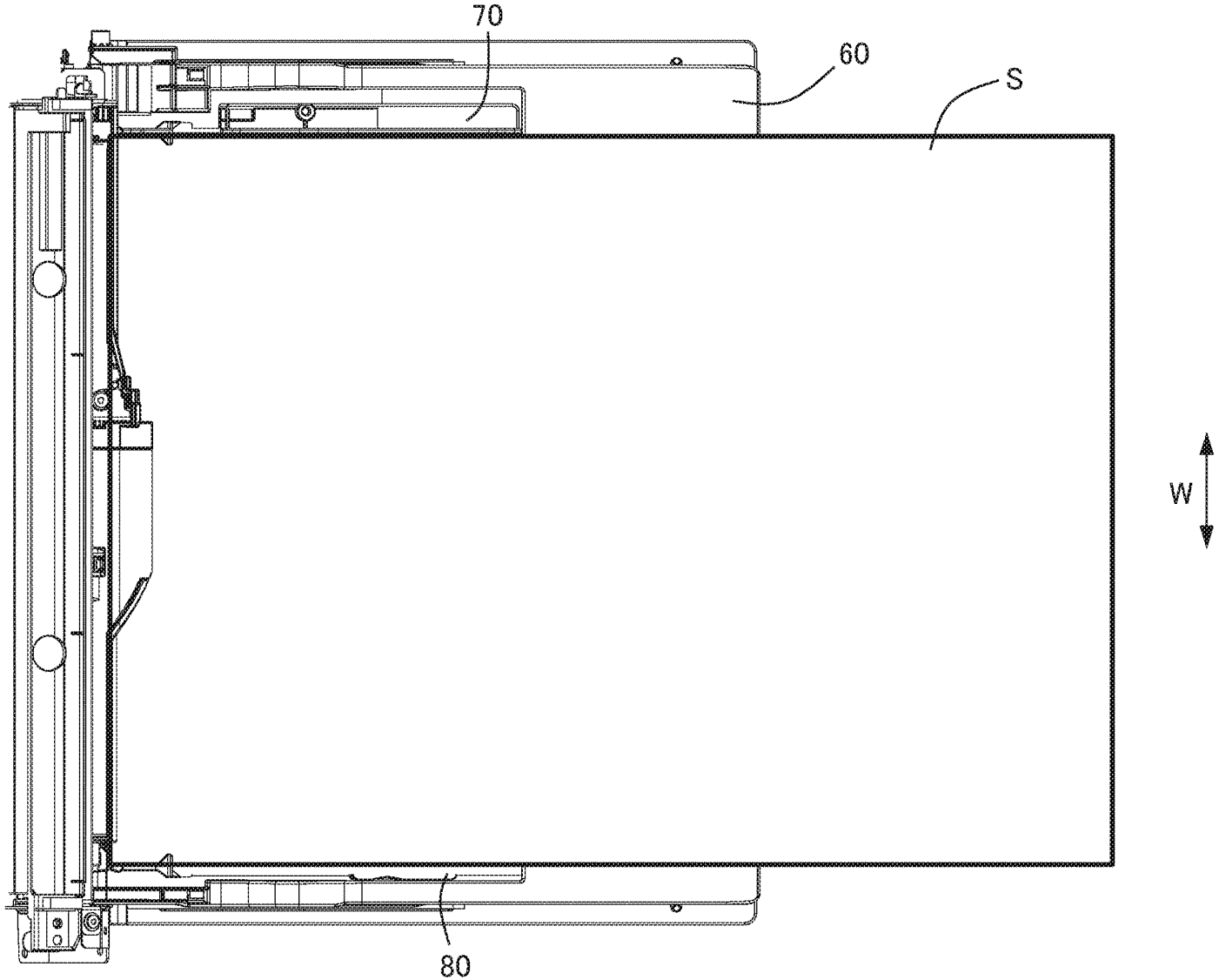
FIG. 4 is a plan view illustrating a state in which sheets are normally placed on the manual feed tray according to the first embodiment.

The seating surface portions 72 and 82 support a bottom surface of the sheet S placed on the manual feed tray 60. The regulation surface portions 73 and 83 are provided continuously with the seating surface portions 72 and 82, and abut on the end portion of the sheet S in the width direction W to regulate the position of the sheet S in the width direction W. When the user operates the first side regulating portion 70 and the second side regulating portion 80, the regulation surface portions 73 and 83 regulate the end portion of the sheet S in the width direction W as illustrated in FIG. 4, and position the sheet S in the width direction W with respect to the image forming unit 2.

Seating Surface Portion and Regulation Surface Portion

Next, the seating surface portions 72 and 82 and the regulation surface portions 73 and 83, which are characteristic configurations of the manual feeding unit 6 according to the present embodiment, will be described in detail. Here, the first side regulating portion 70 will be described, but the second side regulating portion 80 has the same configuration. The seating surface portion 72 has a seating surface color indicating portion 72*a* as an example of a supporting surface color indicating portion on the entire upper surface. However, the seating surface color indicating portion 72*a* may be disposed at least at an end portion on the regulation surface portion 73 side (regulation surface portion side). The regulation surface portion 73 has a regulation surface color indicating portion 73*a* on the entire surface facing the sheet S. However, the regulation surface color indicating portion 73*a* may be disposed at least at an end portion on the seating surface portion 72 side (seating surface portion side).

The colors of the seating surface color indicating portion 72*a* and the regulation surface color indicating portion 73*a* will be described below. Since the sheet S used in the image forming apparatus 1 often has a color with high brightness, for example, white, the seating surface color indicating portion 72*a* may have a color with brightness that contrasts with the color of the sheet S, for example, black (indicated by hatching for convenience in FIG. 3). The regulation surface color indicating portion 73*a* may have a color having contrast with the color of the seating surface color indicating portion 72*a* and having brightness similar to that of the sheet S, for example, white. In the present embodiment, the brightness of the color will be described by applying the brightness (represented from 0 as black to 10 as white in stepwise manner) in the Munsell color system.

Assuming that the brightness of a commonly used white sheet S is 9, the brightness of the seating surface color indicating portion 72*a* may be 7 or less in order to ensure the contrast with the sheet S. When the brightness of the seating surface color indicating portion 72*a* is 5 or less based on the brightness 9 of the sheet S, the brightness difference is 4 or more, so that the contrast with the sheet S is increased, which is preferable. Therefore, in the present embodiment, the brightness of the seating surface color indicating portion 72*a* is 5.

The regulation surface color indicating portion 73*a* may have a color with brightness different from brightness of the seating surface color indicating portion 72*a*. Furthermore, if the regulation surface color indicating portion 73*a* has a color whose brightness is larger than brightness of the seating surface color indicating portion 72*a* by 4 or more, the contrast with the seating surface color indicating portion 72*a* increases, which is preferable. In particular, it is desirable that the regulation surface color indicating portion 73*a* has a color with brightness of which difference from the brightness 9 of the sheet S is 3 or less, that is, a color with brightness of 6 or more. Therefore, in the present embodiment, the brightness of the regulation surface color indicating portion 73*a* is 9.

In the present embodiment, the first side regulating portion 70 is formed by a two-color molding method. Accordingly, the color of the seating surface color indicating portion 72*a* and the color of the regulation surface color indicating portion 73*a* are made different from each other. The color of the seating surface color indicating portion 72*a* is the base color of the seating surface portion 72, whereby the seating surface color indicating portion 72*a* is formed over the entire seating surface portion 72. However, the method of forming the first side regulating portion 70 is not limited to the two-color molding method, and joining of two parts may be applied, or after injection molding of one color, a seal may be attached to the seating surface portion 72 and the regulation surface portion 73, or coloring may be performed.

Figure 6:
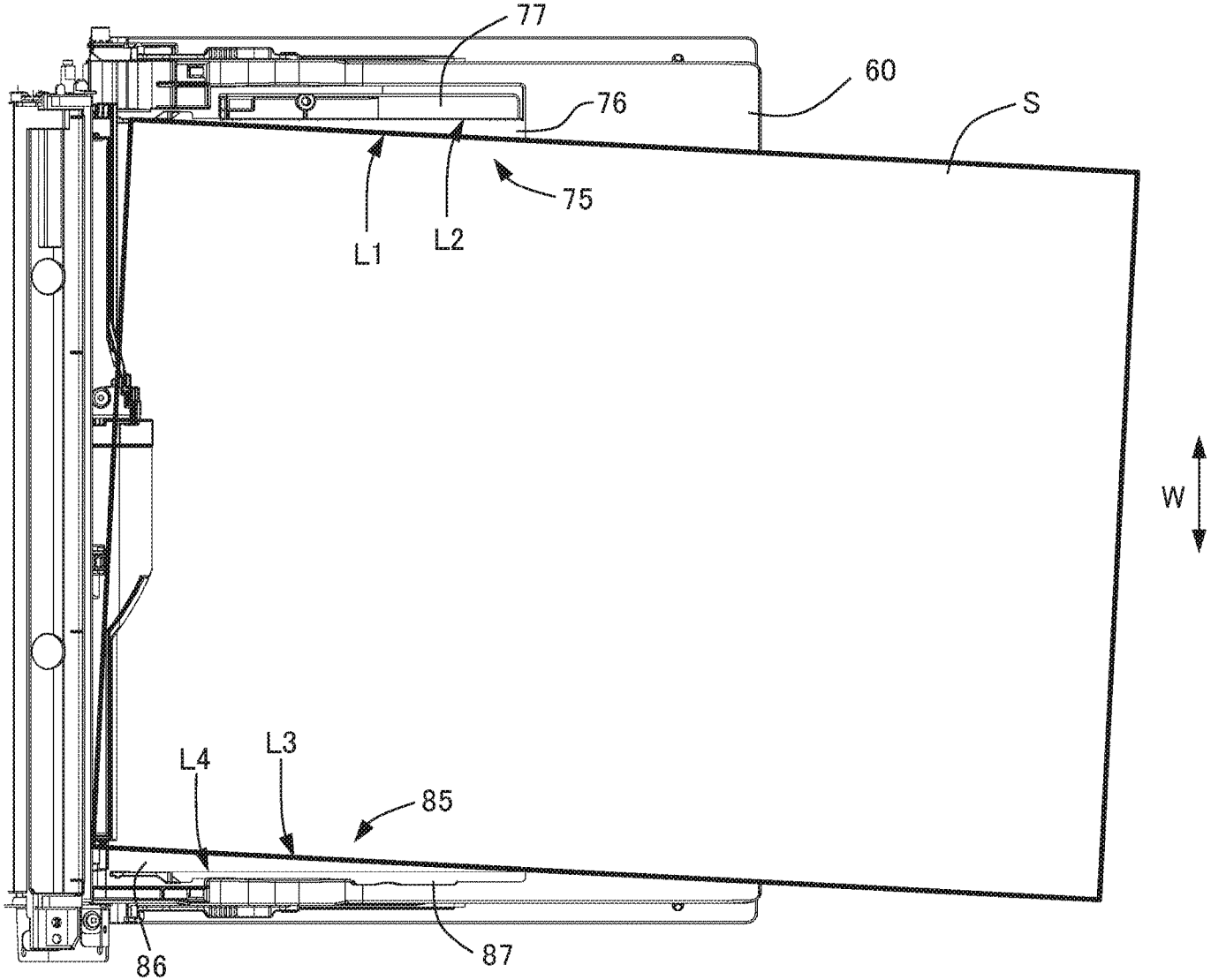
FIG. 6 is a plan view illustrating a state in which sheets are placed on a manual feed tray according to a comparative example in an inclined manner in the width direction.

Here, as a comparative example, as shown in FIG. 6, a case where the seating surface portions 76 and 86 of the first side regulating portion 75 and the second side regulating portion 85 do not have the seating surface color indicating portion, and the regulation surface portions 77 and 87 do not have the regulation surface color indicating portion will be considered. It is assumed that the color of the seating surface portions 76 and 86 and the color of the regulation surface portions 77 and 87 are the same and are white having brightness of 8 or more. It is assumed that the first side regulating portion 75 and the second side regulating portion 85 are opened slightly wider than the width of the sheet S, and the sheet S is placed in an inclined manner in the width direction W. In this case, a boundary line L1 between the sheet S and the seating surface portion 76 and a boundary line L2 between the seating surface portion 76 and the regulation surface portion 77 are hardly recognized on the first side regulating portion 75 side. Similarly, a boundary line L3 between the sheet S and the seating surface portion 86 and a boundary line L4 between the seating surface portion 86 and the regulation surface portion 87 are hardly recognized on the second side regulating portion 85 side. For this reason, it is difficult for the user to recognize that the sheet S is inclined with respect to the feeding direction, and there is a possibility that image formation is started as it is. When the inclination angle of the sheet S is large, even if the skew feeding is to be corrected in the registration unit 56 (see FIG. 1), there is a possibility that misalignment of the image formed on the sheet S will occur without being able to be corrected, and there is a possibility that wrinkles or the like will occur on the sheet S due to stress applied on the sheet S.

Figure 5:
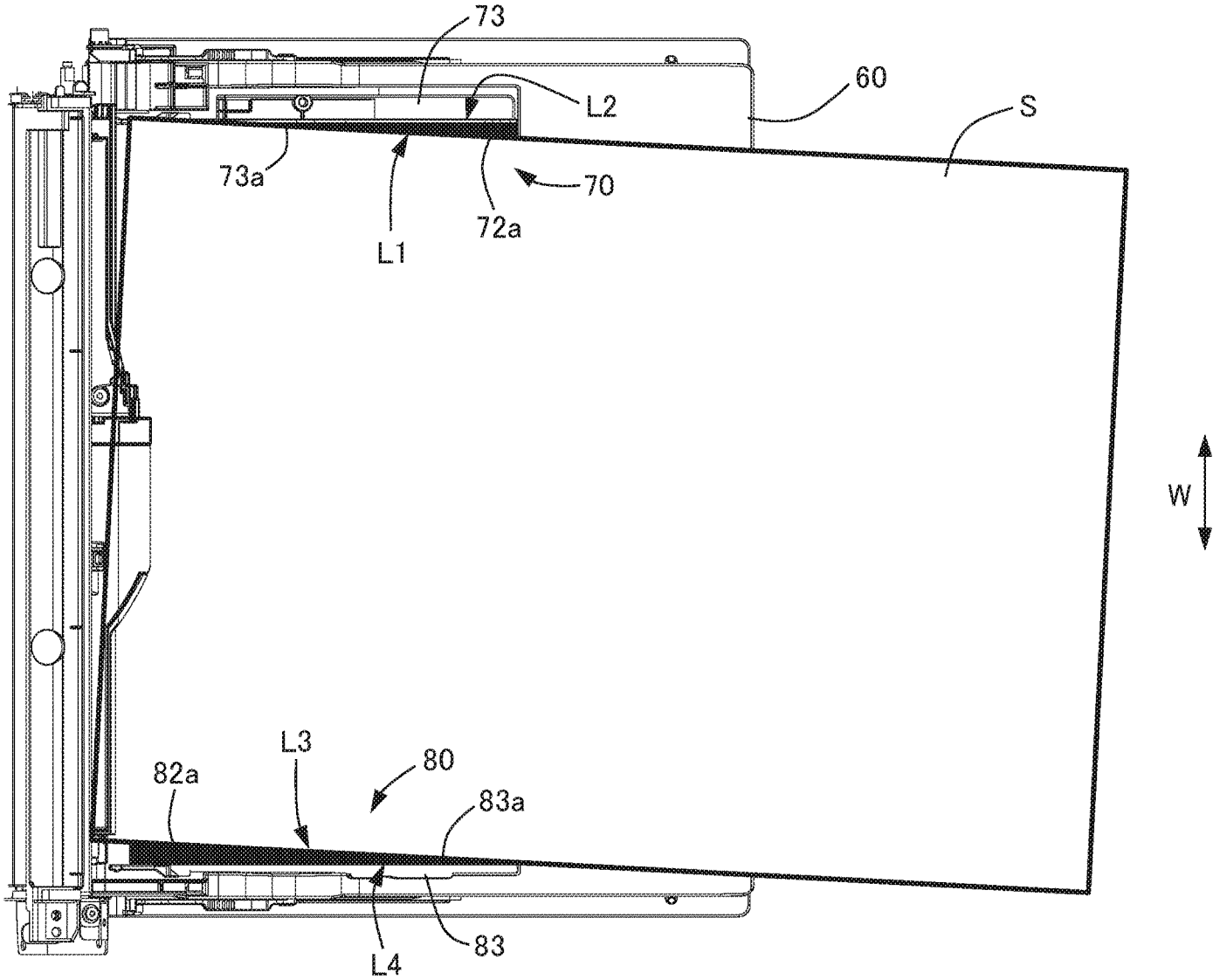
FIG. 5 is a plan view illustrating a state in which sheets are placed on the manual feed tray according to the first embodiment in an inclined manner in the width direction.

On the other hand, in the present embodiment, as illustrated in FIG. 5, the seating surface color indicating portions 72*a* and 82*a* may have a color of black having brightness that contrasts with the color of the sheet S, and the regulation surface color indicating portions 73*a* and 83*a* may have a color of white that contrasts with the color of the seating surface color indicating portions 72*a* and 82*a*. Therefore, on the side of the first side regulating portion 70, the visibility of the boundary line L1 between the sheet S and the seating surface color indicating portion 72*a* and the boundary line L2 between the seating surface color indicating portion 72*a* and the regulation surface color indicating portion 73*a* is improved and becomes easy to recognize. Similarly, on the side of the second side regulating portion 80, the visibility of the boundary line L3 between the sheet S and the seating surface color indicating portion 82*a* and the boundary line L4 between the seating surface color indicating portion 82*a* and the regulation surface color indicating portion 83*a* is improved and becomes easy to recognize. As a result, it is emphasized that the boundary lines L1 and L2 or L3 and L4 are not parallel, and the user can recognize that the sheet S is placed in an inclined manner.

As described above, according to the manual feeding unit 6 of the present embodiment, the brightness of the seating surface color indicating portion 72*a* may be 5 of black, and the brightness of the regulation surface color indicating portion 73*a* may be 9 of white. Therefore, for example, when the sheet S having brightness of 9 is placed on the manual feed tray 60, the boundary lines L1 and L3 between the sheet S and the seating surface color indicating portions 72*a* and 82*a* and the boundary lines L2 and L4 between the seating surface color indicating portions 72*a* and 82*a* and the regulation surface color indicating portions 73*a* and 83*a* are easily recognized. As a result, it is emphasized that the boundary lines L1 and L2 or L3 and L4 are not parallel, and it is possible to cause the user to recognize that the sheet S is placed in an inclined manner, and thus, it is possible to suppress occurrence of misalignment of the image formed on the sheet S, wrinkles of the sheet S, and the like.

That is, it is possible to emphasize that the edge of the sheet S and the regulation surface are inclined by making difference in brightness between the color of the seating surface of the pair of side regulating portions 70 and 80 that regulates the position of the sheet S on the manual feed tray 60 in the width direction W and the color of the sheet S and the regulation surface. As a result, it is possible to cause the user to recognize that the sheet S is inclined and urge the user to correctly set the sheet S, and as a result, it is possible to prevent misalignment of the image formed on the sheet S, wrinkles caused by stress applied on the sheet S by the skew feeding correction unit, and the like.

Further, according to the manual feeding unit 6 of the present embodiment, since the seating surface color indicating portions 72*a* and 82*a* have a color with brightness of 5 or less, for example, the brightness thereof is smaller than the sheet S with brightness of 9 by 4 or more. Therefore, the visibility of the user can be further improved by increasing the contrast.

Further, according to the manual feeding unit 6 of the present embodiment, since the brightness of the regulation surface color indicating portions 73*a* and 83*a* is larger than the brightness of the seating surface color indicating portions 72*a* and 82*a* by 4 or more, the contrast with the seating surface color indicating portions 72*a* and 82*a* increases. The regulation surface color indicating portions 73*a* and 83*a* are configured to have a color with brightness of which difference from the brightness 9 of the sheet S is 3 or less, that is, a color with brightness of 6 or more. Therefore, the visibility of the user can be further improved by increasing the contrast.

Further, according to the manual feeding unit 6 of the present embodiment, the color of the seating surface color indicating portions 72*a* and 82*a* is the base color of the seating surface portions 72 and 82, and thus, the seating surface color indicating portions 72*a* and 82*a* are formed on the entire seating surface portions 72 and 82. Therefore, as compared with the case where seals are attached or colored later to form the seating surface color indicating portions 72*a* and 82*a*, these processes can be reduced. The same applies to the regulation surface color indicating portions 73*a* and 83*a*.

In the manual feeding unit 6 of the present embodiment described above, the case where the color of the seating surface color indicating portions 72*a* and 82*a* is black and the color of the regulation surface color indicating portions 73*a* and 83*a* is white has been described, but is not limited thereto. For example, the regulation surface color indicating portions 73*a* and 83*a* may have a color of white having brightness of over 9 and brighter than the sheet S. Alternatively, for example, the seating surface color indicating portions 72*a* and 82*a* may have a color of light black with brightness of 5, and the regulation surface color indicating portions 73*a* and 83*a* may have a color of dark black with brightness of 1. Alternatively, for example, the visibility may be enhanced by adding hue and saturation in addition to black and white.

Second Embodiment

Figure 7:
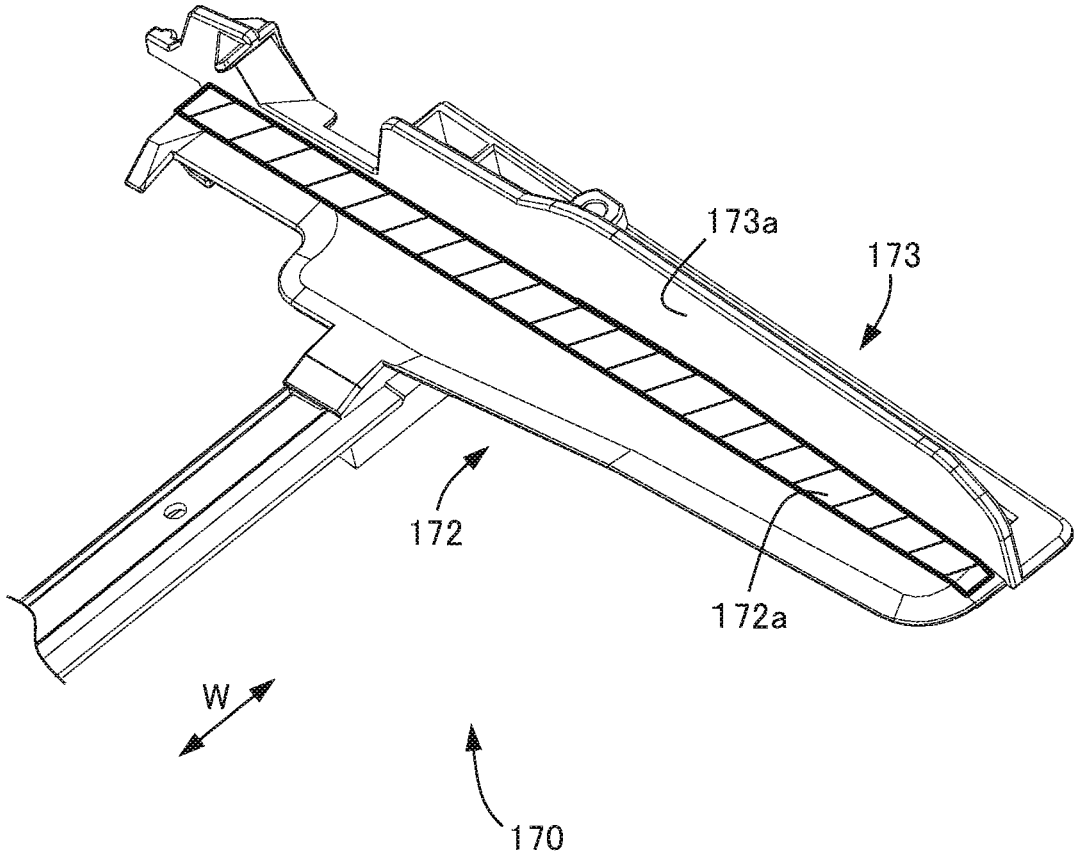
FIG. 7 is a perspective view illustrating a schematic configuration of a first side regulating portion according to a second embodiment.

Next, a second embodiment of the present disclosure will be described in detail with reference to FIG. 7. The present embodiment is different from the first embodiment in that a seating surface color indicating portion 172*a* is formed in a part of a seating surface portion 172. However, the other configurations are the same as those of the first embodiment, and thus the detailed description thereof will be omitted with the same reference numerals. In the present embodiment, a first side regulating portion 170 will be described, but the same applies to a second side regulating portion, and thus a detailed description thereof will be omitted.

In the present embodiment, the seating surface color indicating portion 172*a* is disposed at the end portion on a regulation surface portion 173 side on the upper surface of the seating surface portion 172 of the first side regulating portion 170. That is, the seating surface color indicating portion 172*a* is formed on a part of the seating surface adjacent to a regulation surface color indicating portion 173*a*. In this case, it is preferable that the seating surface color indicating portion 172*a* has a width of, for example, about 5 mm in the width direction W, and the boundary line L1 (see FIG. 5) between the sheet S and the seating surface color indicating portion 172*a* is clearly viewed even if the placed sheet S is greatly inclined.

As described above, according to the manual feeding unit 6 of the present embodiment, since the seating surface color indicating portion 172*a* is provided only in a part of the seating surface portion 172, for example, in a case where a seal is attached or colored, a processing area can be made smaller than that in a case where the entire seating surface portion is processed.

Third Embodiment

Next, a third embodiment of the present disclosure will be described in detail with reference to FIGS. 8 to 11B. The present embodiment is different from the first embodiment in that a seating surface portion 272 is provided with a seating surface pattern portion 272*a* as an example of a supporting surface pattern portion and a regulation surface portion 273 is provided with a regulation surface plain portion 273*a*. However, the other configurations are the same as those of the first embodiment, and thus the detailed description thereof will be omitted with the same reference numerals. In the present embodiment, a first side regulating portion 270 will be described, but the same applies to a second side regulating portion, and thus a detailed description thereof will be omitted.

The seating surface pattern portion 272*a* is arranged at least at an end portion on the regulation surface portion 273 side, and a pattern is formed on the entire seating surface pattern portion. The seating surface pattern portion 272*a* is formed on the entire upper surface of the seating surface portion 272. The regulation surface plain portion 273*a* is disposed at least at an end portion on the seating surface portion 272 side, and is entirely plain. The regulation surface plain portion 273*a* is formed on the entire surface of the regulation surface portion 273 on the side where the sheet S is placed in the width direction W. The term "plain" means that no pattern is formed. The pattern of the seating surface pattern portion 272*a* is formed by providing an uneven shape on the surface of the seating surface portion 272. However, it is not limited to providing the uneven shape, and the pattern may be formed by sealing or coloring.

Figure 8:
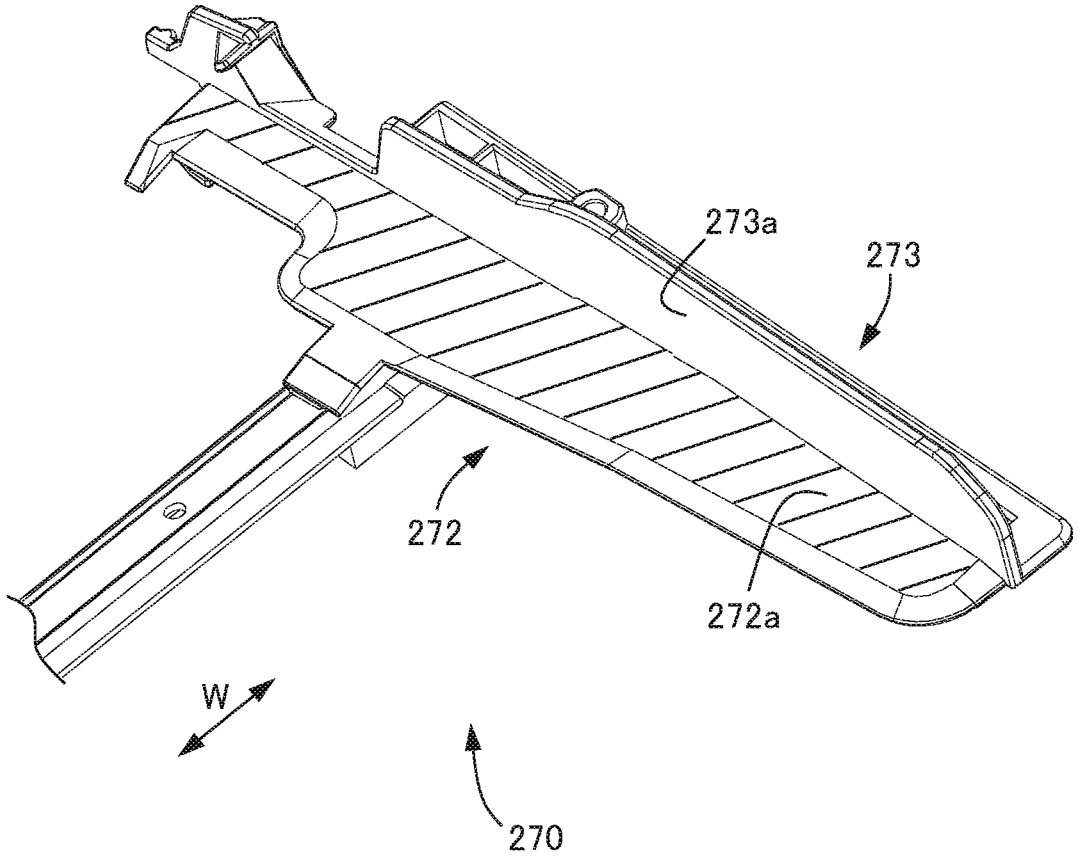
FIG. 8 is a perspective view illustrating a schematic configuration of a first side regulating portion according to a third embodiment.
Figure 9A:
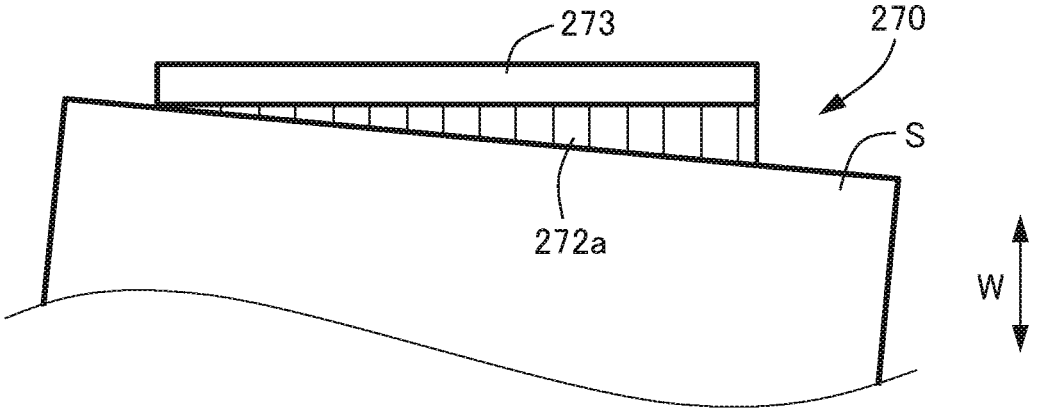
FIG. 9A is a plan view illustrating a schematic configuration in a case where the first side regulating portion according to the third embodiment has a striped pattern.
Figure 9B:
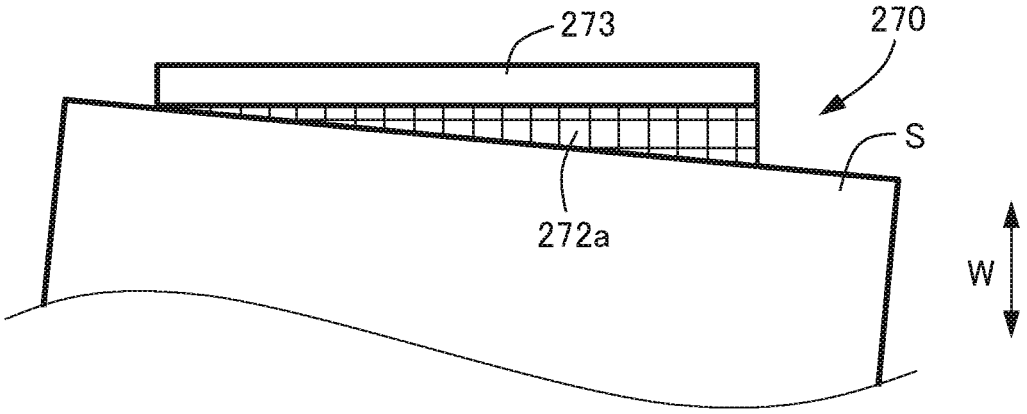
FIG. 9B is a plan view illustrating a schematic configuration in a case where the first side regulating portion according to the third embodiment has a cross-hatched pattern.
Figure 10A:
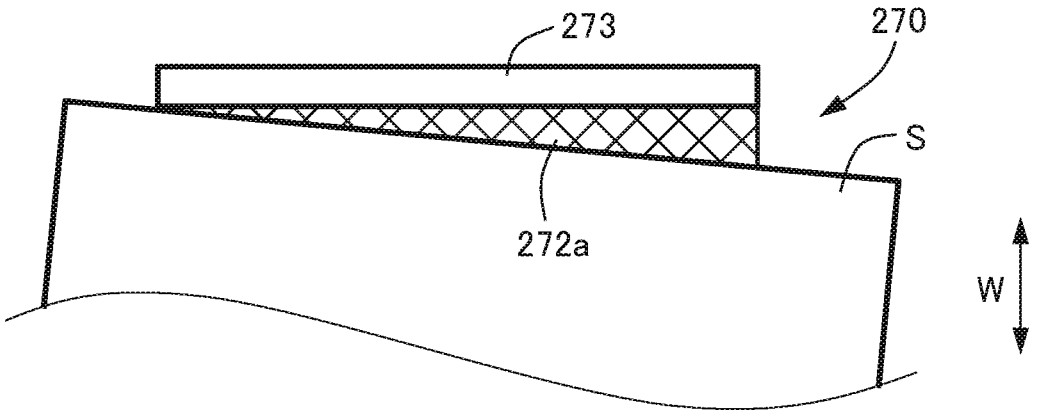
FIG. 10A is a plan view illustrating a schematic configuration in a case where the first side regulating portion according to the third embodiment has an oblique cross-hatched pattern.
Figure 10B:
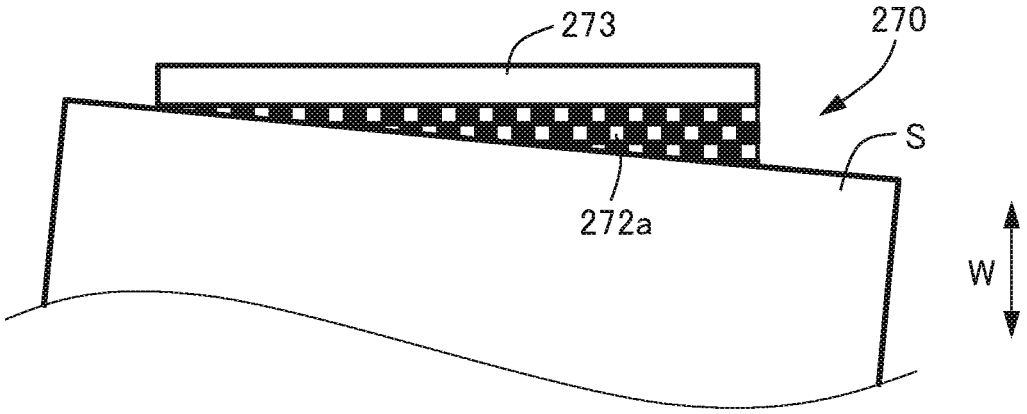
FIG. 10B is a plan view illustrating a schematic configuration in a case where the first side regulating portion according to the third embodiment has a checkered pattern.
Figure 11A:
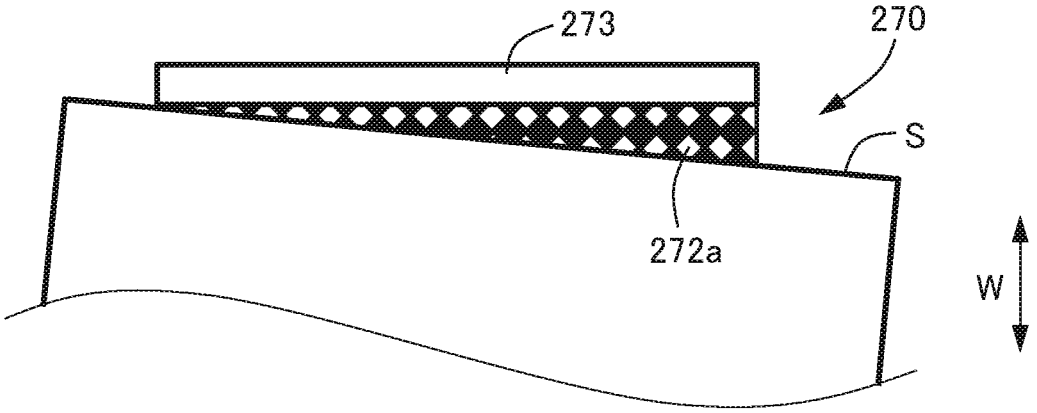
FIG. 11A is a plan view illustrating a schematic configuration in a case where the first side regulating portion according to the third embodiment has an oblique checkered pattern.

The pattern of the seating surface pattern portion 272*a* may have, for example, a hatching shape inclined at, for example, about 45° with respect to the width direction W as illustrated in FIG. 8, or a stripe shape along the width direction W as illustrated in FIG. 9A. Further, as illustrated in FIG. 9B, one side of the pattern may have a cross hatching shape (lattice shape) along the width direction W, or as illustrated in FIG. 10A, one side of the pattern may have a cross hatching shape inclined at about 45° with respect to the width direction W, for example. Furthermore, as illustrated in FIG. 10B, a checkered pattern in which the sides are along the width direction W can be adopted, or as illustrated in FIG. 11A, a checkered pattern in which the sides are inclined at, for example, about 45° with respect to the width direction W can be adopted. However, it is a matter of course that the pattern of the seating surface pattern portion 272*a* is not limited to the pattern described above.

Figure 11B:
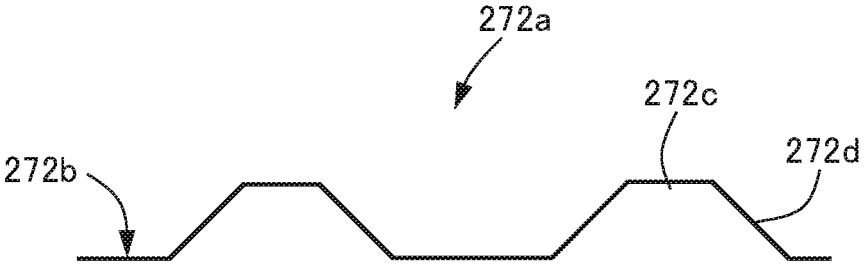
FIG. 11B is a cross-sectional view illustrating a protrusion of a pattern in the first side regulating portion according to the third embodiment.

As illustrated in FIG. 11B, the pattern of the seating surface pattern portion 272*a* includes a protrusion 272*c* protruding from a placement surface 272*b* on which the sheet S is placed. Instead of the protrusion 272*c*, a recess recessed from the placement surface 272*b* may be provided, and at least one of the protrusion 272*c* and the recess may be provided. The seating surface pattern portion 272*a* has an inclined portion 272*d* in which the protrusion 272*c* and the placement surface 272*b* are continuous with each other at an obtuse angle in the cross section. As a result, when the sheet S moves in the width direction W or the feeding direction, it is possible to suppress the leading edge of the sheet S from being caught by the pattern formed in the seating surface pattern portion 272*a*.

As described above, according to the manual feeding unit 6 of the present embodiment, the seating surface pattern portion 272*a* is provided on the seating surface portion 272, and the regulation surface plain portion 273*a* is provided on the regulation surface portion 273. Therefore, since it is possible to cause the user to recognize that the sheet S is placed in an inclined manner, it is possible to suppress the occurrence of misalignment of the image formed on the sheet S, wrinkles of the sheet S, and the like.

Fourth Embodiment

Figure 12:
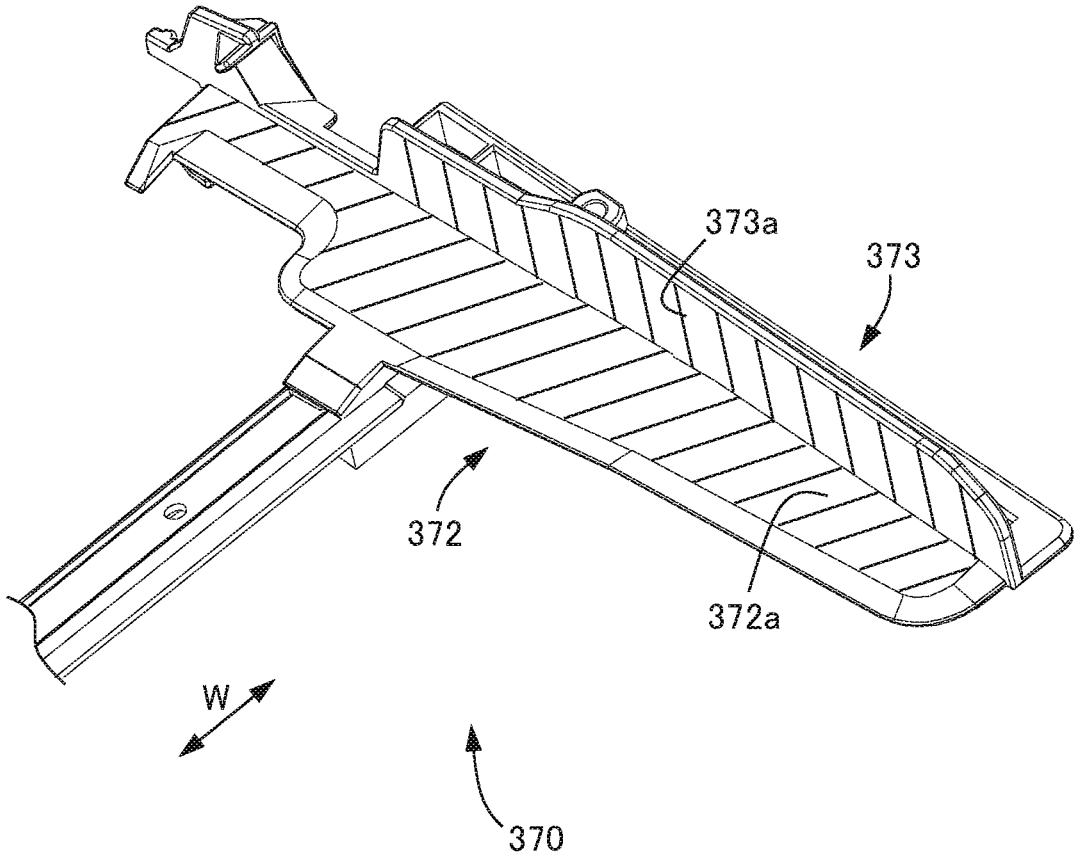
FIG. 12 is a perspective view illustrating a schematic configuration of a first side regulating portion according to a fourth embodiment.

Next, a fourth embodiment of the present disclosure will be described in detail with reference to FIG. 12. The present embodiment is different from the third embodiment in that a regulation surface pattern portion 373*a* is provided on a regulation surface portion 373. However, the other configurations are the same as those of the third embodiment, and thus the detailed description thereof will be omitted with the same reference numerals. In the present embodiment, a first side regulating portion 370 will be described, but the same applies to a second side regulating portion, and thus a detailed description thereof will be omitted. A seating surface portion 372 and a seating surface pattern portion 372*a* are similar to the seating surface portion 272 and the seating surface pattern portion 272*a* of the third embodiment.

The regulation surface pattern portion 373*a* is arranged at least at an end portion on the seating surface portion 372 side, and a pattern is formed on the entire regulation surface pattern portion. The regulation surface pattern portion 373*a* is formed on the entire surface of the regulation surface portion 373 on the side where the sheet S is placed in the width direction W. The pattern of the regulation surface pattern portion 373*a* is different from the pattern of the seating surface pattern portion 372*a*. As a result, even if the placed sheet S is greatly inclined, the boundary line L2 (see FIG. 5) between the seating surface pattern portion 372*a* and the regulation surface pattern portion 373*a* can be clearly viewed. The pattern of the regulation surface pattern portion 373*a* is formed by providing an uneven shape on the surface of the regulation surface portion 373. However, it is not limited to providing the uneven shape, and the pattern may be formed by sealing or coloring. As the pattern of the seating surface pattern portion 272*a*, the pattern described in the third embodiment and other patterns can be appropriately applied.

As described above, according to the manual feeding unit 6 of the present embodiment, the seating surface pattern portion 372*a* is provided on the seating surface portion 372, and the regulation surface pattern portion 373*a* is provided on the regulation surface portion 373. Therefore, since it is possible to cause the user to recognize that the sheet S is placed in an inclined manner, it is possible to suppress the occurrence of misalignment of the image formed on the sheet S, wrinkles of the sheet S, and the like.

Fifth Embodiment

Figure 13:
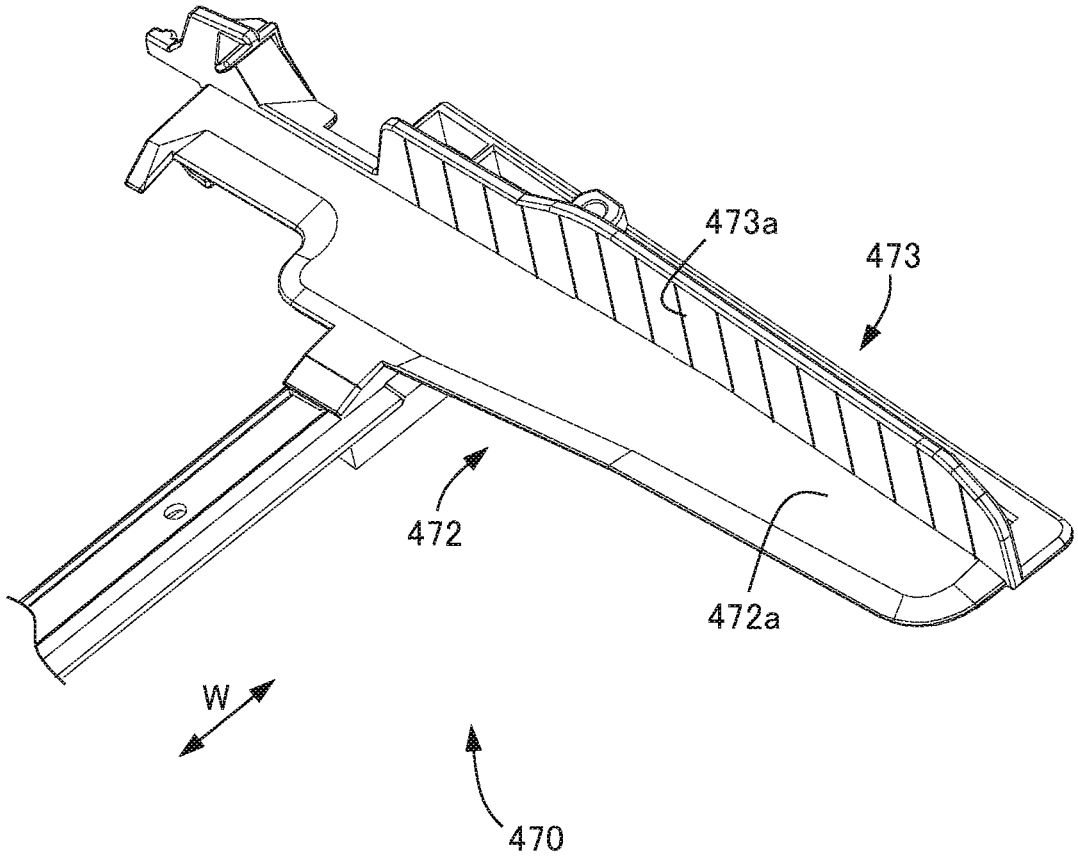
FIG. 13 is a perspective view illustrating a schematic configuration of a first side regulating portion according to a fifth embodiment.

Next, a fifth embodiment of the present disclosure will be described in detail with reference to FIG. 13. The present embodiment is different from the first embodiment in that a seating surface portion 472 is provided with a seating surface color indicating portion 472*a* and a regulation surface portion 473 is provided with a regulation surface pattern portion 473*a*. However, the other configurations are the same as those of the first embodiment, and thus the detailed description thereof will be omitted with the same reference numerals. In the present embodiment, a first side regulating portion 470 will be described, but the same applies to a second side regulating portion, and thus a detailed description thereof will be omitted.

A seating surface portion 472 and a seating surface color indicating portion 472*a* are similar to the seating surface portion 72 and the seating surface color indicating portion 72*a* of the first embodiment. That is, the brightness of the seating surface color indicating portion 472*a* may be 7 or less, and the brightness is preferably 5 or less, and in the present embodiment, the brightness is 5. A regulation surface portion 473 and a regulation surface pattern portion 473*a* are similar to the regulation surface portion 373 and the regulation surface pattern portion 373*a* of the fourth embodiment.

As described above, according to the manual feeding unit 6 of the present embodiment, the seating surface color indicating portion 472*a* is provided on the seating surface portion 472, and the regulation surface pattern portion 473*a* is provided on the regulation surface portion 473. Therefore, since it is possible to cause the user to recognize that the sheet S is placed in an inclined manner, it is possible to suppress the occurrence of misalignment of the image formed on the sheet S, wrinkles of the sheet S, and the like.

In the first to fifth embodiments described above, the case where the first side regulating portion and the second side regulating portion have the same configuration has been described, but is not limited thereto, and only the first side regulating portion may have the above-described configuration, and the second side regulating portion may not have the same configuration.

Other Embodiments

In addition, in the manual feeding unit 6 in the present disclosure, a case where the manual feeding unit 6 is applied to a unit that feeds the image forming sheet S in the image forming apparatus 1 has been described, but is not limited thereto. For example, the present disclosure may be applied to the automatic feeding unit 10 that automatically feeds a document. In this case, it is possible to suppress the occurrence of misalignment of reading of an image formed on the document sheet, wrinkles of the document sheet, and the like.

According to the present disclosure, it is possible to suppress occurrence of misalignment of an image formed on a sheet, wrinkles of the sheet, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-131440, filed Aug. 11, 2021, which is hereby incorporated by reference herein in its entirety.

What is claimed is:

1. A sheet feeding device, comprising:

a sheet supporting unit configured to support a sheet;

a sheet feeding unit configured to feed the sheet supported on the sheet supporting unit in a feeding direction; and a regulating member provided to be movable in a width direction intersecting the feeding direction and configured to regulate a position of the sheet supported on the sheet supporting unit in the width direction, wherein the regulating member includes a supporting surface portion on which the sheet is placed, and a regulation surface portion provided continuously with the supporting surface portion and configured to abut on an end portion of the sheet in the width direction to regulate the position of the sheet in the width direction, wherein the supporting surface portion includes a supporting surface color indicating portion including an end portion of the supporting surface portion on a side of the regulation surface portion and having a color with brightness of 7 or less in the Munsell color system, and wherein the regulation surface portion includes a regulation surface color indicating portion including an end portion of the regulation surface portion on a side of the supporting surface portion and having a color with brightness higher than the brightness of the supporting surface color indicating portion.

2. The sheet feeding device according to claim 1, wherein the supporting surface color indicating portion has a color with brightness of 5 or less in the Munsell color system.

3. The sheet feeding device according to claim 2, wherein the regulation surface color indicating portion has a color with brightness which is greater than brightness of the supporting surface color indicating portion by 4 or more in the Munsell color system.

4. The sheet feeding device according to claim 2, wherein the regulation surface color indicating portion has a color with brightness of 6 or more in the Munsell color system.

5. The sheet feeding device according to claim 1, wherein the supporting surface color indicating portion is formed on the entire supporting surface portion.

6. The sheet feeding device according to claim 5, wherein the regulation surface color indicating portion is formed on the entire regulation surface portion.

7. The sheet feeding device according to claim 1, wherein the supporting surface color indicating portion is formed on a part of the supporting surface portion.

8. The sheet feeding device according to claim 1, wherein the regulating member is a first regulating member configured to abut on one end portion of the sheet supported on the sheet supporting unit in the width direction, wherein the sheet feeding device further comprises a second regulating member provided to be movable in the width direction in conjunction with the first regulating member and configured to abut on another end portion of the sheet supported on the sheet supporting unit in the width direction, and wherein the second regulating member includes another supporting surface portion having the same color as the color of the supporting surface portion and another regulation surface portion having the same color as the regulation surface portion.

9. A sheet feeding device, comprising:

a sheet supporting unit configured to support a sheet;

a sheet feeding unit configured to feed the sheet supported on the sheet supporting unit in a feeding direction; and a regulating member that is provided to be movable in a width direction intersecting the feeding direction and configured to regulate a position of the sheet supported on the sheet supporting unit in the width direction, wherein the regulating member includes a supporting surface portion on which the sheet is placed, and a regulation surface portion provided continuously with the supporting surface portion and configured to abut on an end portion of the sheet in the width direction to regulate the position of the sheet in the width direction, wherein the supporting surface portion includes a supporting surface pattern portion including an end portion of the supporting surface portion on a side of the regulation surface portion and having a pattern formed on the entire supporting surface pattern portion, and wherein the regulation surface portion includes a regulation surface plain portion including an end portion of the regulation surface portion on a side of the supporting surface portion and being entirely plain.

10. The sheet feeding device according to claim 9, wherein the pattern of the supporting surface pattern portion includes at least one of a protrusion protruding from a placement surface on which the sheet is placed and a recess recessed from the placement surface, and wherein the supporting surface pattern portion includes an inclined portion in which the placement surface and at least one of the protrusion and the recess are continued to form an obtuse angle in a cross section.

11. A sheet feeding device, comprising:

a sheet supporting unit configured to support a sheet;

a sheet feeding unit configured to feed the sheet supported on the sheet supporting unit in a feeding direction; and a regulating member that is provided to be movable in a width direction intersecting the feeding direction and configured to regulate a position of the sheet supported on the sheet supporting unit in the width direction, wherein the regulating member includes a supporting surface portion on which the sheet is placed, and a regulation surface portion provided continuously with the supporting surface portion and configured to abut on an end portion of the sheet in the width direction to regulate the position of the sheet in the width direction, wherein the supporting surface portion includes a supporting surface pattern portion including an end portion of the supporting surface portion on a side of the regulation surface portion and having a pattern formed on the entire supporting surface pattern portion, and wherein the regulation surface portion includes a regulation surface pattern portion including an end portion of the regulation surface portion on a side of the supporting surface portion and having a pattern different from the pattern of the supporting surface pattern portion formed on the entire regulation surface pattern portion.

12. The sheet feeding device according to claim 11, wherein the pattern of the supporting surface pattern portion includes at least one of a protrusion protruding from a placement surface on which the sheet is placed and a recess recessed from the placement surface, and wherein the supporting surface pattern portion includes an inclined portion in which the placement surface and at least one of the protrusion and the recess are continued to form an obtuse angle in a cross section.

13. A sheet feeding device, comprising:

a sheet supporting unit configured to support a sheet;

a sheet feeding unit configured to feed the sheet supported on the sheet supporting unit in a feeding direction; and a regulating member that is provided to be movable in a width direction intersecting the feeding direction and configured to regulate a position of the sheet supported on the sheet supporting unit in the width direction, wherein the regulating member includes a supporting surface portion on which the sheet is placed, and a regulation surface portion provided continuously with the supporting surface portion and configured to abut on an end portion of the sheet in the width direction to regulate a position of the sheet in the width direction, wherein the supporting surface portion includes a supporting surface color indicating portion including an end portion of the supporting surface portion on a side of the regulation surface portion and having a color with brightness of 7 or less in the Munsell color system, and wherein the regulation surface portion includes a regulation surface pattern portion including an end portion of the regulation surface portion on a side of the supporting surface portion and having a pattern formed on the entire regulation surface pattern portion.

14. An image forming apparatus, comprising:

the sheet feeding device according to claim 1; and an image forming unit configured to form an image on a sheet fed by the sheet feeding device.

* * * * *